US010288079B2

(12) United States Patent
Skertic

(10) Patent No.: US 10,288,079 B2
(45) Date of Patent: May 14, 2019

(54) SINGULAR STATOR VANE CONTROL

(71) Applicant: Rolls-Royce North American Technologies, Inc., Indianapolis, IN (US)

(72) Inventor: Richard J. Skertic, Carmel, IN (US)

(73) Assignee: ROLLS-ROYCE NORTH AMERICA TECHNOLOGIES, INC., Indianapolis, IN (US)

( * ) Notice: Subject to any disclaimer, the term of this patent is extended or adjusted under 35 U.S.C. 154(b) by 381 days.

(21) Appl. No.: 15/194,294

(22) Filed: Jun. 27, 2016

(65) Prior Publication Data

US 2017/0370370 A1 Dec. 28, 2017

(51) Int. Cl.
*F01D 17/16* (2006.01)
*F04D 27/00* (2006.01)
(Continued)

(52) U.S. Cl.
CPC ..... *F04D 27/002* (2013.01); *F01D 17/162* (2013.01); *F04D 27/0246* (2013.01); *F04D 29/321* (2013.01); *F04D 29/563* (2013.01)

(58) Field of Classification Search
CPC ..... F04D 27/00; F04D 27/02; F04D 27/0246; F04D 27/002; F04D 29/56; F04D 29/563; F01D 17/00; F01D 17/10; F01D 17/12; F01D 17/14; F01D 17/16; F01D 17/162; F05D 2260/50; F05D 2260/53; F05D 2260/57; F05D 2260/70; F05D 2260/71; F05D 2260/74; F05D 2260/76; F05D 2270/10; F05D 2270/101
See application file for complete search history.

(56) References Cited

U.S. PATENT DOCUMENTS 5,005,353 A 4/1991 Acton et al.
5,230,603 A 7/1993 Day
(Continued)

FOREIGN PATENT DOCUMENTS

GB 2 294 094 4/1996
GB 2294094 A * 4/1996 ..... F01D 17/08
(Continued)

OTHER PUBLICATIONS

Mark Wan, "Forced Induction", dated May 20, 2016, pp. 1-8, AutoZine Technical School, http://www.autozine.org/technical_school/engine/tech_engine_3.htm#VTG.
(Continued)

*Primary Examiner* — Richard A Edgar
(74) *Attorney, Agent, or Firm* — Brinks Gilson & Lione

(57) ABSTRACT

Systems and methods for controlling stators of a compressor of a gas turbine engine are provided. The stators and rotatable blades may be included in a stage of the compressor. The rotatable blades may be configured to rotate about an axial axis of the compressor, and each of the stators is rotatable about a corresponding vane axis that extends radially outward from the axial axis of the compressor. Electric motors may be coupled to the stators, where each of the electric motors is configured to individually rotate a corresponding one of the stators in the compressor. A motor controller may be configured to cause the electric motors to rotate the stators in unison or individually.

15 Claims, 6 Drawing Sheets

(51) Int. Cl.

| | |
|---|---|
| ***F04D 27/02*** | (2006.01) |
| ***F04D 29/32*** | (2006.01) |
| ***F04D 29/56*** | (2006.01) |

(56) References Cited

U.S. PATENT DOCUMENTS

| | | | | |
|---|---|---|---|---|
| 6,769,868 | B2 | 8/2004 | Harrold | |
| 7,393,178 | B2 | 7/2008 | Bouru | |
| 8,641,367 | B2 | 2/2014 | Norris et al. | |
| 9,103,228 | B2 | 8/2015 | Waugh et al. | |
| 2005/0147492 | A1 * | 7/2005 | Mahoney | F01D 17/162 415/148 |
| 2009/0297334 | A1 | 12/2009 | Norris et al. | |
| 2013/0276425 | A1 | 10/2013 | Rittenhouse | |

FOREIGN PATENT DOCUMENTS

| | | | | |
|---|---|---|---|---|
| GB | 2 410 530 | | 8/2005 | |
| GB | 2410530 A | * | 8/2005 | F01D 17/162 |

OTHER PUBLICATIONS

P.B. Lawless et al., "Rotating Stall Initiation and Suppression in a Centrifugal Fan", dated 1994, pp. 1-7, International Compressor Engineering Conference, Purdue e-Pubs, Purdue University.

"Turbofan", dated May 17, 2016, pp. 1-21, Wikipedia, http://en.wikipedia.org/wiki/Turbofan.

Extended European Search report, dated Nov. 14, 2017, pp. 1-8, issued in European Patent Application No. 17173204.3, European Patent Office, Munich, Germany.

* cited by examiner

SINGULAR STATOR VANE CONTROL

TECHNICAL FIELD

This disclosure relates to stators for axial compressors and/or turbines used by gas turbine engines and, in particular, to control of the stators.

BACKGROUND

Stators, sometimes referred to as vanes or stator vanes, may be included in compressors of gas turbine engines. Present approaches in controlling the stators of a compressor of a gas turbine engine suffer from a variety of drawbacks, limitations, and disadvantages. Accordingly, there is a need for the inventive apparatuses, systems and methods disclosed herein for controlling stators.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

By way of an introductory example, a system may be provided that includes multiple stators, electric motors for each of the stators, and a motor controller for one or more of the motors. The stators and a set of rotatable blades are included in, for example, a single stage of the compressor. Each of the electric motors is configured to individually rotate a corresponding one of the stators in the stage. During operation of the system, the motor controller(s) may cause the electric motors to rotate the stators in unison. For example, the motor controller may cause the electric motors to rotate in unison to a target angular position.

One interesting feature of the systems and methods described herein may be that the electric motors, in some examples, may weigh less than a traditional mechanical system in which the stators are rotated by a ring that is coupled to the stators via actuator arms, where the ring rotates about an axial axis of the compressor when moved by an arm powered by a hydraulic system. Alternatively, or in addition, an interesting feature of the systems and methods described herein may be that the motor controller(s) may individually control each stator to remove mechanical error, such as slop and/or chatter. For example, manufacturing errors and/or variances may result in one or more of the stators being too far open or two far closed compared to the other stators in the stage. Alternatively or in addition, an interesting feature in some examples may be an improved responsiveness in moving the stators and/or an improved positioning accuracy of the stators. Alternatively or in addition, an interesting feature of the systems and or methods described herein, may be, in some examples, an ability dynamically adjust the angular position of one or more the stators to clear and/or avoid rotating stalls or even full surges.

Figure 1:
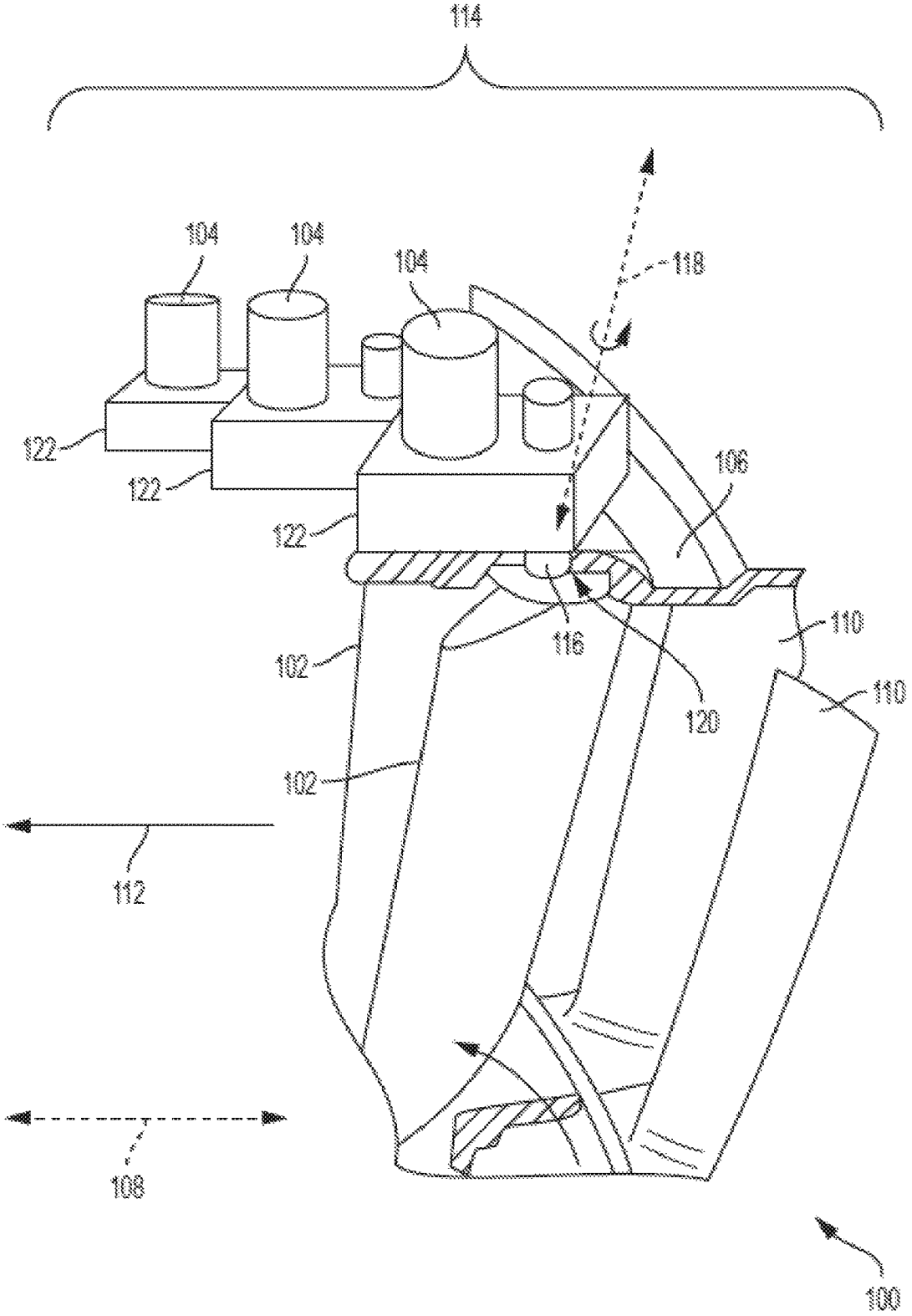
FIG. 1 illustrates an example of a system to control stators of an axial compressor of a gas turbine engine.

FIG. 1 illustrates an example of a system 100 to control stators 102 of an axial compressor of a gas turbine engine. The system 100 may include the stators 102 and electric motors 104 for each corresponding one of the stators 102.

The stators 102 may be arranged so as to extend radially inward from a case 106 of the compressor toward a rotation axis 108 of the compressor. The rotation axis 108 may be a center axis of the compressor or an axis positioned in an axial direction along the compressor. The stators 102 do not rotate about the rotation axis 108. Instead, each of the stators 102 is rotatable about a corresponding vane axis 118 that extends radially from the rotation axis 108 toward, for example, a point 116 at which the stator is coupled to the case 106. In contrast, a set of blades 110 adjacent to the stators 102 rotate about the rotation axis 108.

The blades 110 illustrated in FIG. 1 are upstream from the stators 102 because the direction 112 of the airflow through the compressor is from right to left in FIG. 1. The stators 102, together with the blades 110 shown in FIG. 1, are part of a single stage 114 of the compressor. In some examples, the stage 114 may include additional stators that are completely stationary with respect to the case 106 and do not rotate in any direction. The stators 102 and the blades 110 may be airfoils or any other suitable shape. The stators 102 may be made of any material suitable for the temperature and pressure inside of the compressor.

The blades 110, when rotated around the rotation axis 108, accelerate the air in the direction 112 of the airflow toward the stators 102. The stators 102 convert the increased rotational kinetic energy into static pressure through diffusion and redirect the flow direction of the air for blades of the next stage (not shown) downstream from the stage 114 illustrated in FIG. 1. The stage 114 may represent a radial cross-sectional planar area of the gas turbine engine.

In an axial compressor, gas or working fluid, such as air, flows substantially parallel to the rotation axis 108. The energy level of the fluid increases as the fluid flows through the compressor due to the action of the blades 110 which exert a torque on the fluid. The stators 102 redirect the fluid, converting the circumferential component of flow into pressure.

Each of the electric motors 104 may be configured to individually rotate a corresponding one of the stators 102 around the corresponding vane axis 118. For example, a shaft 120 may extend from each of the stators 102 through the case 106 and into a corresponding one of a set of gear boxes 122 arranged in a row around the case 106. Each of the electric motors 104 may be mechanically coupled to the corresponding one of the gear boxes 122. Each of the gear boxes 122 is configured to rotate the shaft 120 about the corresponding vane axis 118 when a stator of the corresponding one of the electric motors 104 rotates. Each of the gear boxes 122 may have a gear ratio that increases the torque applied to the shaft 120 from the torque generated by the corresponding one of the electric motors 104.

While the example in FIG. 1 includes the stators 102 and the blades 110 of the single stage 114, the system 100 may include additional sets of stators and blades that are part of one or more additional stages of the compressor. In such examples, the system 100 may include additional electric motors that are configured to individually rotate corresponding stators in the one or more additional stages of the compressor. Alternatively or in addition, the stators 102 and the blades 110 of the single stage 114 may all be included in a portion of the single stage 114 in some examples.

Figure 2:
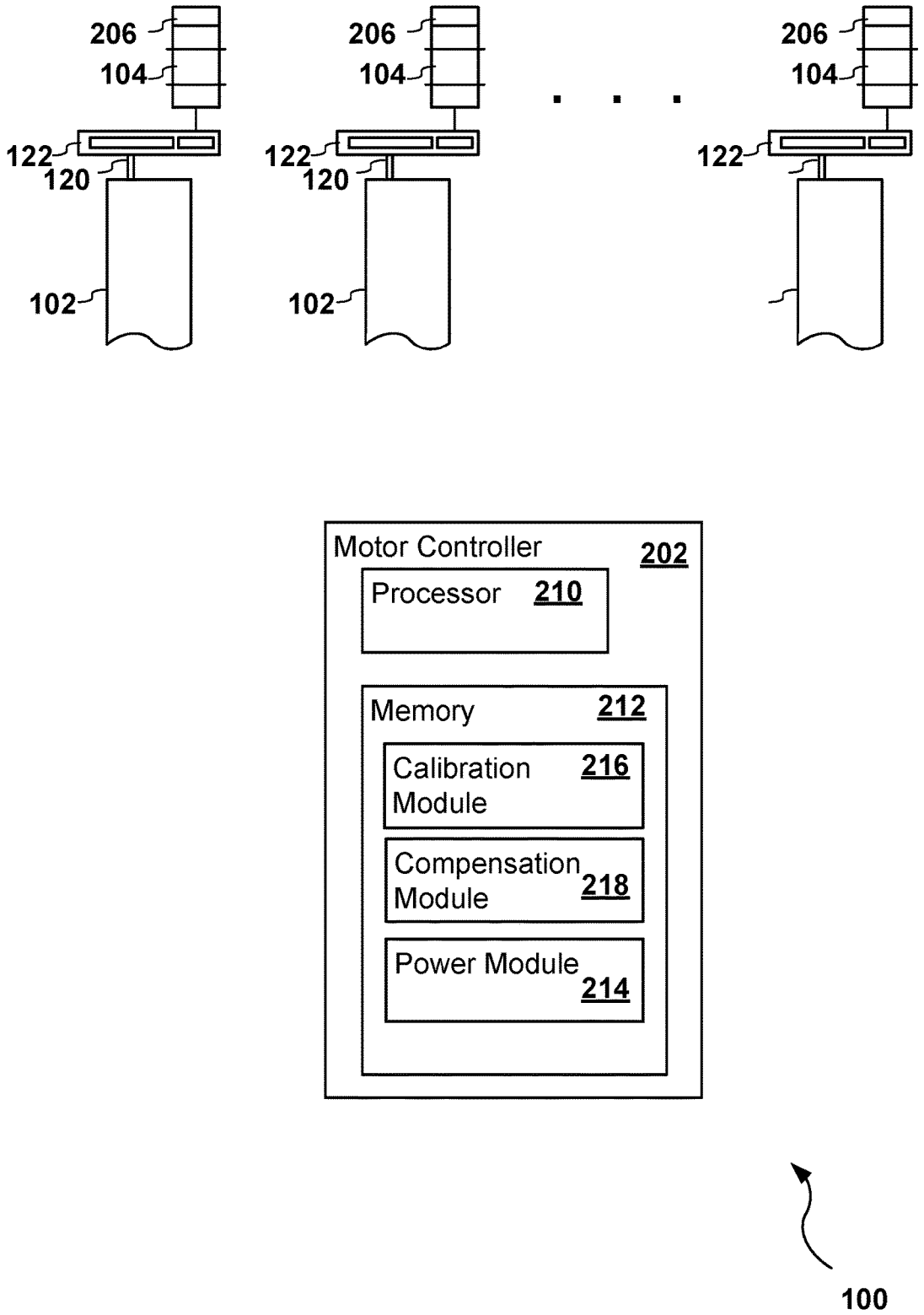
FIG. 2 illustrates a logical block diagram of the system.

Referring to FIG. 2, which illustrates a logical block diagram of the system 100, the system 100 may include a motor controller 202. The motor controller 202 may be configured to control the electric motors 104. For example, the motor controller 202 may be electrically connected to the electrical motors 202. Alternatively or in addition, the motor controller 202 may be in communication with one or more intermediate motor controllers (not shown) that, in turn, control the electric motors 104 in accordance with instructions received from the motor controller 202. For example, each of the electric motors 104 may have a corresponding motor controller and the motor controller 202 illustrated in FIG. 2 communicates with the corresponding motor controllers.

The system 100 illustrated in FIG. 2 also includes resolvers 206. Each of the resolvers 206 may be any device that provides an electrical indication of an amount of rotation of a shaft. For example, each of the resolvers 206 may be any rotary electrical transformer configured to indicate a number of degrees of rotation. The resolvers 206 shown in FIG. 2 indicate an amount of rotation or angular position of a shaft of the electric motors 202. Alternatively or in addition, the resolvers 206 may indicate an amount of rotation or an angular position of the shaft 120 extending from each of the stators 102.

The motor controller 202 may include a processor 210 and a memory 212. The memory 212 may include a power module 214, a calibration module 216, and a compensation module 218. The power module 214, the calibration module 216, and the compensation module 218 may include instructions executable by the processor 210.

In some examples, the memory 212 may include a communications module (not shown) that manages communication with motor controllers corresponding to each of the motors 104. The communications module may communicate with the corresponding motor controllers over a network (not shown). For example, the communications module may implement the TCP/IP (Transmission Control Protocol Internet Protocol) protocol, the I2C (Inter-Integrated Circuit) bus protocol, the CAN bus protocol defined by ISO 11898-1, a peer-to-peer protocol (for example, Gnutella, Gossip, or Kazaa), or any other communications protocol. The communications module may handle communications over the network on behalf of the power module 214, the calibration module 216, the compensation module 218 and/or any other module of the motor controller 202.

As explained in more detail below, the power module 214 may be configured to cause the electric motors 104 to rotate the stators 102 in unison thereby effecting the amount of air compression generated by the compressor and, as a result, the amount of power generated by the gas turbine engine. The calibration module 216 may be configured to cause one or more of the electric motors 104 to calibrate one or more corresponding ones of the stators 102 due to manufacturing and/or assembly variances in the stators 102 or other parts of the compressor. The compensation module 218 may be configured to cause one or more of the electric motors to adjust one or more corresponding ones of the stators 102 so as to compensate for a failure event and/or a potential failure event. For example, the compensation module 218 may attempt to clear or avoid a rotating stall and/or a full surge event. In another example, the compensation module 218 may attempt to compensate for damage to one or more of the stators 102 by adjusting the stators 102 that neighbor the damaged stators.

Figure 3:
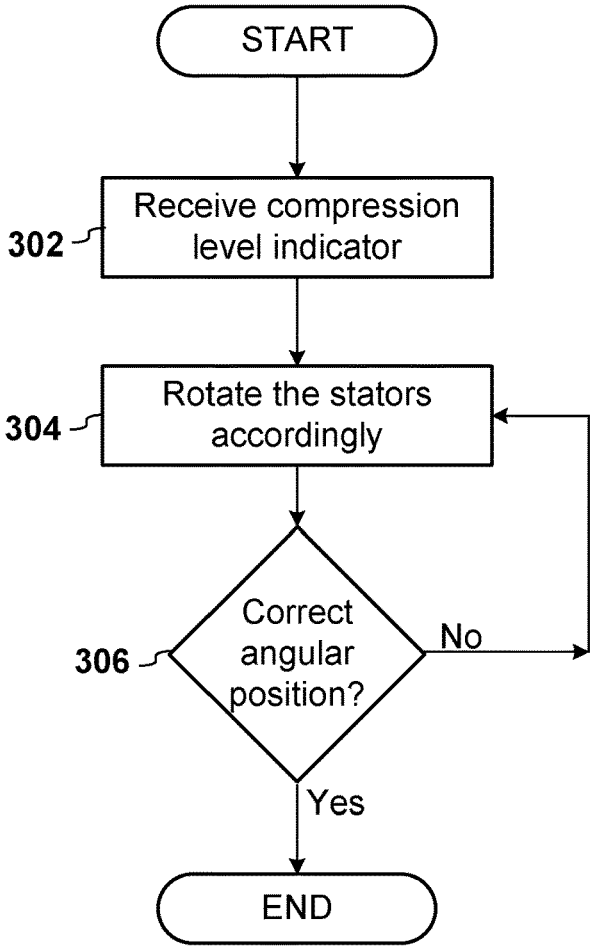
FIG. 3 illustrates a flow diagram of example logic of a power module.

FIG. 3 illustrates a flow diagram of example logic of the power module 214. During operation of the system 100, the power module 214 may perform operations.

The operations may start with receipt (302) of a compression level indicator. The compression level indicator may be any indication of compression level. Examples of the compression level indicator may include a pressure value, an angle of rotation of one or more of the stators 102, a target change in pressure, a target change in angle of rotation of one or more of the stators 102, a target power level, a change in power level, or any other indication of a target compression level. The motor controller 202 and/or the power module 214 may receive (302) the compression level indicator from, for example, any other component of the gas turbine engine or vehicle, such as a main controller.

The stators 102 may be rotated (304) to a target position based on the compression level indicator. For example, the power module 214 may determine which of the stators 102 is to be rotated and/or the target angle to rotate the stators 102 in order to obtain the target compression indicated by the compression level indicator. The power module 214 may cause the stators 102 to rotate accordingly by, for example, communicating with the electric motors 104.

An angular position may be received from the resolvers 206 and checked (306) against the target position. If the positions do not match, then operations may return to causing the stators 102 to be rotated (304) to the target position. On the other hand, if the positions do match, operations may end.

Operations may end, for example, by waiting to receive a second compression level indicator, and repeating the logic of the power module 214 with the receipt (302) of the second compression level indicator.

The logic may not include the check (306) against the target position in some examples. Instead, the electric motors 104 may be, for example, pre-calibrated stepper motors which accurately go to a target position when instructed by the motor controller 202.

Figure 4:
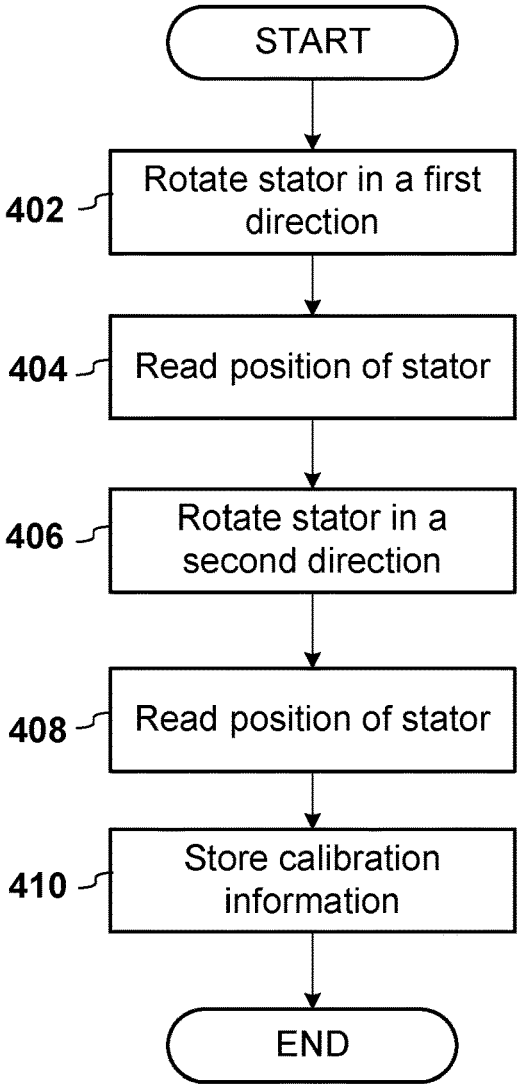
FIG. 4 illustrates a flow diagram of example logic of a calibration module.

FIG. 4 illustrates a flow diagram of example logic of the calibration module 216. During operation of the system 100, the calibration module 216 may perform operations. The operations of the calibration module 216 may be performed before or during startup of the gas turbine engine. Alternatively or in addition, the operations of the calibration module 216 may be performed in response to user input that indicates calibration should be performed.

The operations may start with a rotation (402) of one or more of the stators 102 in a first direction, such as counter clockwise, until the stator(s) reach a stop point. A stop point may be a point at which the stator(s) are physically prevented from, or encounter resistance to, rotating further in a direction. Alternatively or in addition, the stop point may represent a fully closed or fully open position of the stator (s). To cause the rotation (402), the calibration module 216 may cause the electric motors 104 corresponding to the one or more of the stators 102 to rotate. The calibration module 216 may cause the electric motors 104 to rotate independently of each other because each of the stators 102 may have a different range of motion than the other of the stators 102.

Next, an indication of a position or positions of the one or more of the stators 102 may be read (404) from the resolvers 206. For example, the calibration module 216 may receive the indication of the position(s) from corresponding one or more of the resolvers 206. The position(s) indicate the angular position(s) of the stop point(s) in the first direction the stator(s) were rotated. The angular position(s) of the stop point may vary from stator to stator.

The operations may continue with a rotation (406) of the one or more stators 202 in a second direction, such as clockwise, until the stator(s) reach a stop point. To cause the rotation (406), the calibration module 216 may cause the electric motors 104 corresponding to the one or more of the stators 102 to rotate in the second direction.

Next, a position or positions of the one or more of the stators 102 may be read (408) from the resolvers 206. For example, the calibration module 216 may receive the position(s) from corresponding one or more of the resolvers 206. The position(s) indicate the angular position(s) of the stop point(s) in the second direction the stator(s) were rotated. The position(s) of the stop point may vary from stator to stator.

Calibration information may be stored (410) in the memory 212 and/or any other physical memory. The calibration information may be any information that indicates the positions of the stop points. Examples of the calibration information may include angular positions of the stop points, an angular offset that may be added or subtracted to a desired angular position to obtain an actual angular position of the stator that corresponds to the desired angular position.

Operations may end by, for example, performing the logic of the power module 214. Using the calibration information, the power module 214 may more accurately determine the target position of a stator from the compression level indicator.

As noted above, the compensation module 218 may detect and/or correct a surge event and/or a rotating stall event. During a full axial surge event, a pressure wave may form in the gas turbine engine and have a first pressure wave frequency in the axial direction of the gas turbine engine For a rotating stall event, which is a circumferentially non-uniform flow, (local section of blocked axial flow), a pressure wave may form in the gas turbine engine and rotate around the rotor at a speed of about half that of the physical shaft speed when the rotating stall event occurs. The rotational frequency of the pressure wave during the rotating stall event may have a second pressure wave frequency.

Accordingly, to detect the surge event or the rotating stall event, the system 100 may include pressure sensors (not shown) distributed circumferentially around the compressor and/or the turbine. The system 100 may include pressure sensors distributed longitudinally along the compressor and/or the turbine. The sampling rate of the pressure sensors may be higher than the first pressure wave frequency to detect the surge event. Alternatively or in addition, the sampling rate of the pressure sensors may be higher than the second pressure wave frequency to detect the rotating stall event.

Figure 5:
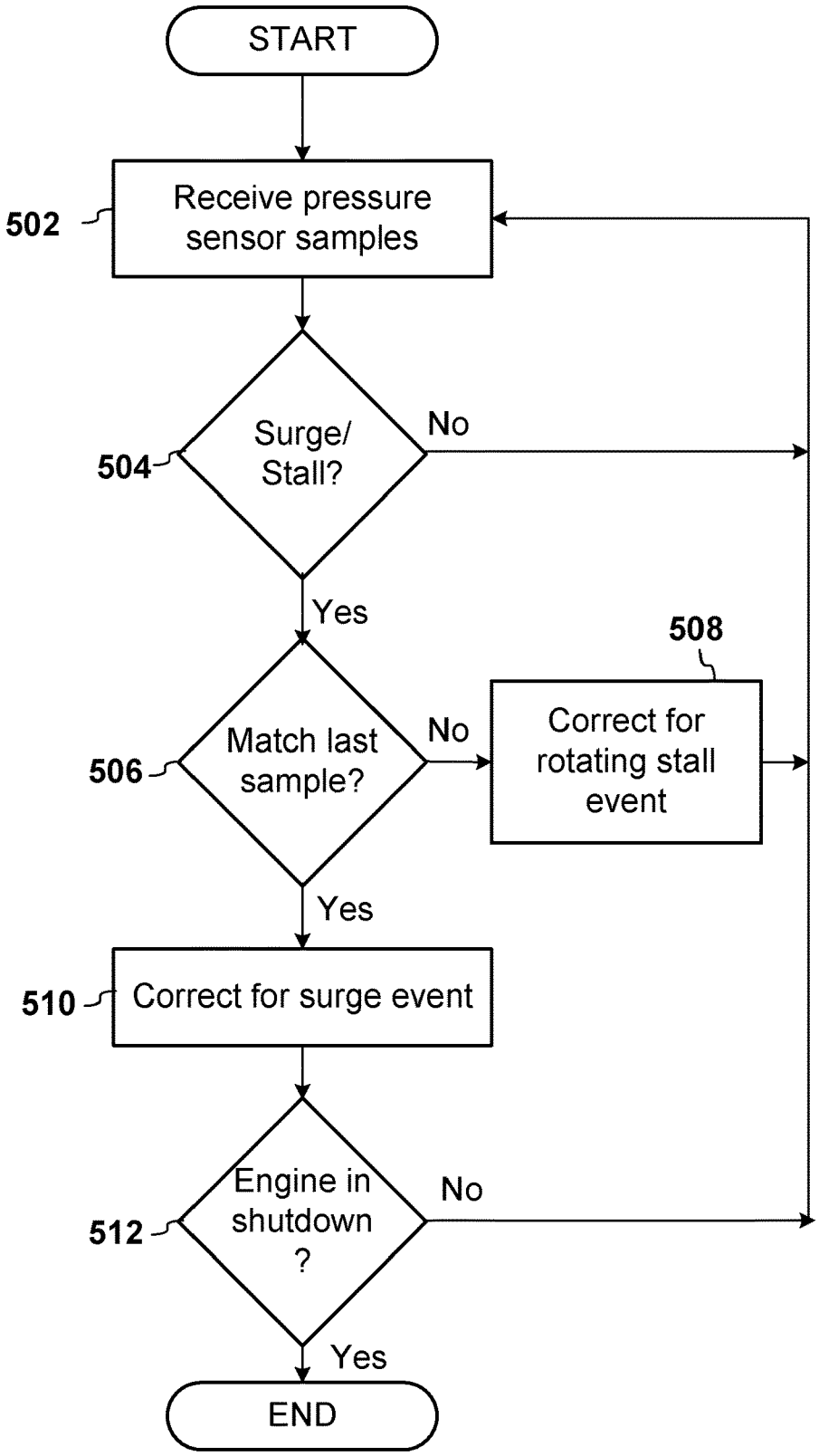
FIG. 5 illustrates a flow diagram of example logic of a compensation module.

FIG. 5 illustrates a flow diagram of example logic of the compensation module 218 to detect and compensate for surge events and rotating stall events. During operation of the system 100, the compensation module 218 may perform operations. The operations of the compensation module 218 may be performed during operation of the gas turbine engine. Alternatively or in addition, the operations of the compensation module 218 may be performed in response to user input that indicates calibration should be performed.

The operations may start with receipt (502) of the pressure sensor samples from the pressure sensors. The samples may be collected from the pressure sensors distributed circumferentially around the compressor within a compressor stage and/or around a stage of the turbine and/or from the pressure sensors distributed longitudinally along the compressor and/or the turbine.

Next, a determination (504) may be made whether any of the pressure sensor samples match conditions of a surge event and/or a rotating stall event. For example, if the pressure sensor samples indicate the pressure is below a threshold value compared to neighboring pressures, then the sensor samples may match conditions of a surge event. If the pressure sensor samples do not match the conditions of the surge event or the rotating stall event, then operations may return to the receipt (502) of a next chronological set of pressure sensor samples.

Alternatively, if the pressure sensor samples match the conditions of the surge event and/or the rotating stall event, then operations may proceed to check (506) whether the match affects a radial cross-sectional planar area. In other words, determine whether the match indicates the pressure wave is moving circumferentially around or longitudinally in the compressor and/or the turbine.

If the pressure wave is moving circumferentially, then operations may correct (508) for a rotating stall event. For example, the compensation module 218 may modulate (rotate) one or more of the stators 102 upstream from and at the location of the rotating stall event. Additional options to correct for the rotating stall event may include changing fuel flow to a combustor of the gas turbine engine, bleeding off air downstream, and/or varying the geometry of a flow path through the gas turbine engine. Operations may return to the receipt (502) of a next chronological set of pressure sensor samples.

Alternatively, if the pressure wave is moving longitudinally, then operations may correct (510) for a surge event. For example, the compensation module 218 may modulate (rotate) one or more of the stators 102. Additional options to correct for the surge event may include changing fuel flow to a combustor of the gas turbine engine, bleeding off air downstream, and/or varying the geometry of a flow path through the gas turbine engine.

After correcting (510) for the surge event, the gas turbine engine may be checked (512) to see if the gas turbine engine is in shutdown mode. For example, the engine may be in shutdown mode if the surge event becomes potentially damaging and/or if the gas turbine engine is manually or otherwise shutdown. If the engine is not in shutdown mode, operations may return to the receipt (502) of a next chronological set of pressure sensor samples.

Alternatively, if the engine is in shutdown mode, then the operations may end, for example, by completing the shutdown of the gas turbine engine.

The logic of the compensation module 218 illustrated in FIG. 5 includes detecting and correcting for both a rotating stall event and a surge event. In some examples, the compensation module 218 may detect and correct for a rotating stall event, but not detect and correct for a surge event. Alternatively, the compensation module 218 may detect and correct for a surge event, but not detect and correct for rotating stall event. Alternatively or in addition, some other logic may detect a rotating stall event and/or a surge event, and the compensation module 218 may merely correct for the rotating stall event and/or the surge event.

Figure 6:
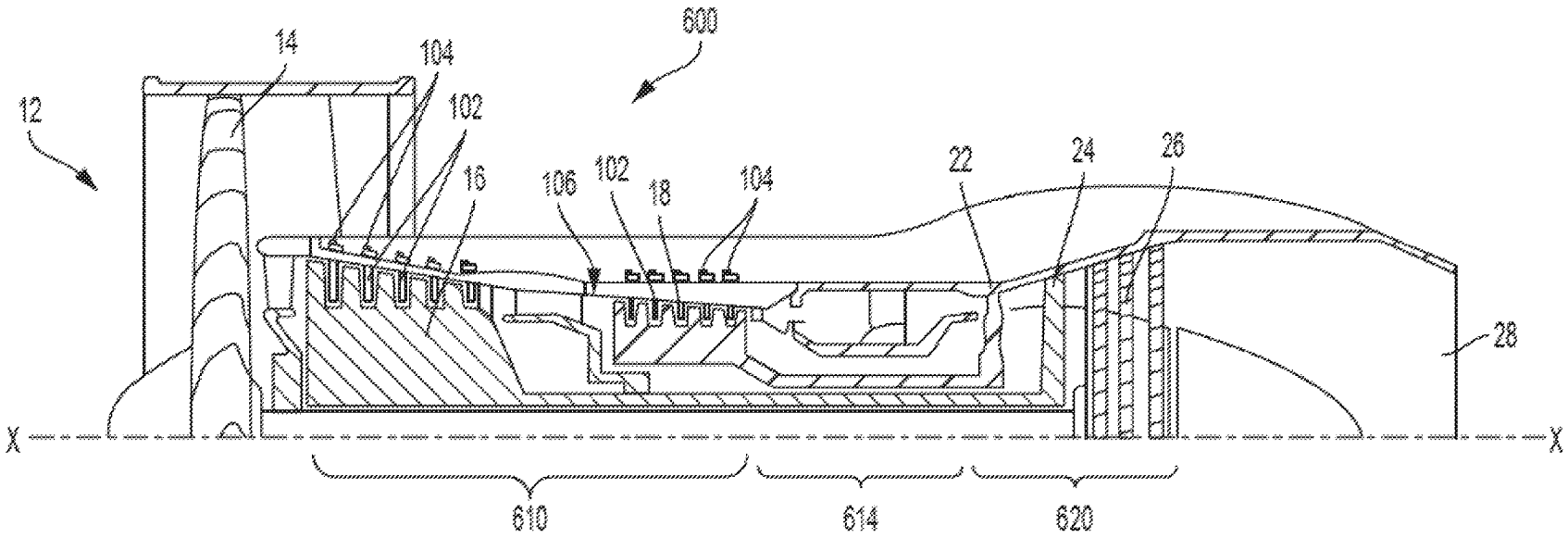
FIG. 6 is a cross-sectional view of an upper half of a gas turbine that includes stators controlled by the system.

FIG. 6 is a cross-sectional view of an upper half of a gas turbine engine 600 that includes the stators 102 controlled by the system 100 described herein. A longitudinal centerline (X-X) of the engine 600 divides the upper half (shown) from the lower half (not shown). The gas turbine engine 600 illustrated in FIG. 6 includes, in the order in which air passes through the engine 600, an air intake 12, a propulsive fan 14, an axial compressor 610 (including an intermediate pressure compressor 16 and a high pressure compressor 18), a combustor 614, a turbine 620 (a high pressure turbine 22, an intermediate pressure turbine 24, a low pressure turbine 26) and an exhaust nozzle 28. The electric motors 104 of the system 100 to control the stators 102 are also shown in FIG. 6.

During operation of the gas turbine engine 600, air enters the intake 12 and is accelerated by the fan 14 to produce two air flows: a first air flow into the intermediate pressure compressor 16 and a second airflow which provides propulsive thrust. Accordingly, the engine 600 illustrated in FIG. 6 is a turbofan. Examples of the gas turbine engine 60 may include a turbofan, a turbojet, a turboprop, or any other type of gas turbine engine.

In the example illustrated in FIG. 6, the intermediate pressure compressor 16 compresses the air flow directed into the intermediate pressure compressor 16. The air compressed by the intermediate pressure compressor 16 flows to the high pressure compressor 18 which further compresses the air. In other examples, the compressor 610 may include a low pressure compressor instead of the intermediate pressure compressor 16. Alternatively, the compressor may include just a single compressor or more than two pressure compressors.

The compressed air exhausted from the compressor 610 is directed into the combustor 614 where the compressed air is mixed with fuel. Fuel may be directed into the combustor 30 through a number of fuel injectors (not shown) located at the upstream end of the combustor 30. In some examples, the fuel injectors may be circumferentially spaced around the engine 600 and serve to provide fuel into air received from the compressor 610. The resultant fuel and air mixture may be then combusted within the combustor 30 generating hot combustion products.

The resultant hot combustion products expand, thereby driving the high, intermediate and low pressure turbines 22, 24 and 26 before being exhausted through the exhaust nozzle 28, which provides a propulsive thrust in addition to the second airflow produced by the fan 14. The high, intermediate and low pressure turbines 22, 24 and 26 respectively drive the high and intermediate pressure compressors 16 and 18 and the fan 14 by suitable interconnecting shafts. In other examples, the turbine 620 may include additional or fewer turbine stages than the example illustrated in FIG. 6.

The case 106 may surround the compressor 610. In the example illustrated in FIG. 6, the electric motors 104 of the system 100 are positioned on an outer surface (radially outward from the center line X-X) of the case 106. The center line X-X is coincident with the rotation axis 108 of the compressor 610 in some examples, but may not be in alternative examples. Each of the electric motors 104 is configured to rotate a corresponding one of the stators 102.

The electric motors 104 may be any type of electrical machine that converts electrical energy into mechanical energy. Examples of the electric motors 104 may include a direct current (DC) motor, an alternating current (AC) motor, a stepper motor, a permanent-split capacitor (PSC) motor, an induction motor, a synchronous motor, and an asynchronous motor. Each of the electric motors 104 may generate a maximum torque that falls in a range of 5 to 80 inch-pounds. Alternatively, the electric motor 104 may have a maximum torque that falls outside of that range.

As described above, each of the gear boxes 122 may have a gear ratio that increases the torque applied to the shaft 120 by the corresponding one of the electric motors 104. The maximum torque applied on each of the stators 102 by air flowing through the compressor 610 during operation of the engine 600 may be, for example, around 25 to 30 inch-pounds. If the electric motor alone cannot generate sufficient torque to offset the torque applied to the stator by the air flow, then the gearbox may be geared so that the electric motor may apply a sufficiently high torque to the stator through the gearbox in order to meet or exceed the torque applied to the stator by the air flow. The gear boxes 122 may each include a gear train. The gear train may be a mechanical system formed by mounting gears on a frame of the gear box so that the teeth of the gears engage.

The system 100 may be implemented with additional, different, or fewer components. For example, the system 100 may include only the motor controller 202, only the combination of the motor controller 202 and the electric motors 104, or only the combination of the motor controller 202, the electric motors 104, the gearboxes 122 and the resolvers 206. In some examples, the system 100 may include the gas turbine engine 600 and/or the compressor 610.

Each component may include additional, different, or fewer components. For example, the memory 212 of the motor controller 202 may include additional, fewer, or different modules than illustrated in FIG. 2.

The logic illustrated in the flow diagrams may include additional, different, or fewer operations than illustrated. The operations illustrated may be performed in an order different than illustrated.

The system 100 may be implemented in many different ways. Each module, such as the power module 214, the calibration module 216, the compensation module 218, and the communications module, may be hardware or a combination of hardware and software. For example, each module may include an application specific integrated circuit (ASIC), a Field Programmable Gate Array (FPGA), a circuit, a digital logic circuit, an analog circuit, a combination of discrete circuits, gates, or any other type of hardware or combination thereof. Alternatively or in addition, each module may include memory hardware, such as a portion of the memory 212, for example, that comprises instructions executable with the processor 210 or other processor to implement one or more of the features of the module. When any one of the module includes the portion of the memory that comprises instructions executable with the processor, the module may or may not include the processor. In some examples, each module may just be the portion of the memory 212 or other physical memory that comprises instructions executable with the processor 210 or other processor to implement the features of the corresponding module without the module including any other hardware. Because each module includes at least some hardware even when the included hardware comprises software, each module may be interchangeably referred to as a hardware module, such as the power hardware module 214, the calibration hardware module 216, and the compensation hardware module 218.

In FIG. 2, only one motor controller 202 is shown. However, in some examples, each of the motors 104 may have a corresponding motor controller like the motor controller 202 illustrated in FIG. 2. The motor controllers for each of the motors 104 may be centrally controlled by a master motor controller, such as the motor controller 202 illustrated in FIG. 2. The motor controllers for each of the motors 104 may include one or more of the modules 214, 216, and 218, such as the calibration module 216. Alternatively or in addition, the motor controllers for each of the motors 104 may operate based on a peer-to-peer algorithm.

For example, the motor controllers may elect one of themselves to perform the features of the compensation module 218 and/or the power module 214. Alternatively or in addition, the motor controller 202 illustrated in FIG. 2 may control only one of the motors 104 and communicate with one of the resolvers 206, and may be part of a larger system that includes additional motor controllers, electric motors, resolvers, and stators.

The network may be any collection of transmission links over which data between network nodes may be exchanged. For example, the network may include a bus, a local area network (LAN), a wired network, a wireless network, a wireless local area network (WLAN), a WI-FI® network (WI-FI is a registered trademark of Wireless Ethernet Compatibility Alliance, Inc. of Austin, Tex.), an Internet Protocol (IP) network, and/or any other communications network.

In FIGS. 1 and 6, the system 100 to control the stators 102 is illustrated as controlling the stators 102 of the axial compressor 610. However, the system 100 is not limited to use with axial compressors. Alternatively or in addition, the system 100 may control stators of the turbine 620 of the gas turbine engine 600 in the same manner as with the stators 102 of the axial compressor 610.

Some features are shown stored in a computer readable storage medium (for example, as logic implemented as computer executable instructions or as data structures in the memory 212). Part of the system 100 and its logic and data structures may be stored on, distributed across, or read from one or more types of computer readable storage media. Examples of the computer readable storage medium may include a hard disk, a floppy disk, a CD-ROM, a flash drive, a cache, volatile memory, non-volatile memory, RAM, flash memory, or any other type of computer readable storage medium or storage media. The computer readable storage medium may include any type of non-transitory computer readable medium, such as a CD-ROM, a volatile memory, a non-volatile memory, ROM, RAM, or any other suitable storage device.

The processing capability of the system 100 may be distributed among multiple entities, such as among multiple processors and memories, optionally including multiple distributed processing systems. Parameters, databases, and other data structures may be separately stored and managed, may be incorporated into a single memory or database, may be logically and physically organized in many different ways, and may implemented with different types of data structures such as linked lists, hash tables, or implicit storage mechanisms. Logic, such as programs or circuitry, may be combined or split among multiple programs, distributed across several memories and processors, and may be implemented in a library, such as a shared library (for example, a dynamic link library (DLL)).

All of the discussion, regardless of the particular implementation described, is exemplary in nature, rather than limiting. For example, although selected aspects, features, or components of the implementations are depicted as being stored in memories, all or part of the system or systems may be stored on, distributed across, or read from other computer readable storage media, for example, secondary storage devices such as hard disks, flash memory drives, floppy disks, and CD-ROMs. Moreover, the various modules and screen display functionality is but one example of such functionality and any other configurations encompassing similar functionality are possible.

The respective logic, software or instructions for implementing the processes, methods and/or techniques discussed above may be provided on computer readable storage media. The functions, acts or tasks illustrated in the figures or described herein may be executed in response to one or more sets of logic or instructions stored in or on computer readable media. The functions, acts or tasks are independent of the particular type of instructions set, storage media, processor or processing strategy and may be performed by software, hardware, integrated circuits, firmware, micro code and the like, operating alone or in combination. Likewise, processing strategies may include multiprocessing, multitasking, parallel processing and the like. In one embodiment, the instructions are stored on a removable media device for reading by local or remote systems. In other embodiments, the logic or instructions are stored in a remote location for transfer through a computer network or over telephone lines. In yet other embodiments, the logic or instructions are stored within a given computer, central processing unit ("CPU"), graphics processing unit ("GPU"), or system.

Furthermore, although specific components are described above, methods, systems, and articles of manufacture described herein may include additional, fewer, or different components. For example, a processor may be implemented as a microprocessor, microcontroller, application specific integrated circuit (ASIC), discrete logic, or a combination of other type of circuits or logic. Similarly, memories may be DRAM, SRAM, Flash or any other type of memory. Flags, data, databases, tables, entities, and other data structures may be separately stored and managed, may be incorporated into a single memory or database, may be distributed, or may be logically and physically organized in many different ways. The components may operate independently or be part of a same program or apparatus. The components may be resident on separate hardware, such as separate removable circuit boards, or share common hardware, such as a same memory and processor for implementing instructions from the memory. Programs may be parts of a single program, separate programs, or distributed across several memories and processors.

A second action may be said to be "in response to" a first action independent of whether the second action results directly or indirectly from the first action. The second action may occur at a substantially later time than the first action and still be in response to the first action. Similarly, the second action may be said to be in response to the first action even if intervening actions take place between the first action and the second action, and even if one or more of the intervening actions directly cause the second action to be performed. For example, a second action may be in response to a first action if the first action sets a flag and a third action later initiates the second action whenever the flag is set.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments have been described, it will be apparent to those of ordinary skill in the art that many more embodiments and implementations are possible.

Accordingly, the embodiments described herein are examples, not the only possible embodiments and implementations.

The subject-matter of the disclosure may also relate, among others, to the following aspects:

1. A system comprising:

a plurality of stators in a compressor for a gas turbine engine, the stators and a plurality of rotatable blades included in a stage of the compressor, the rotatable blades configured to rotate about an axis of the compressor, and each of the stators is rotatable about a corresponding vane axis that extends radially outward from the axis of the compressor;

a plurality of electric motors, each of the electric motors is configured to individually rotate a corresponding one of the stators in the compressor; and a motor controller configured to cause the electric motors to rotate the stators in unison.

2. The system of aspect 1 further comprising a plurality of gear trains, wherein each of the electric motors is mechanically coupled to the corresponding one of the stators by a corresponding one of the gear trains.
3. The system of any of aspects 1 or 2, wherein the motor controller is configured to cause the electric motors to rotate in unison to a target angular position.
4. The system of any of aspects 1 to 3, wherein the motor controller is further configured to cause one or more of the electric motors to rotate one or more of the stators in the stage of the compressor in response to a detection of a stall event and/or a surge event.
5. The system of any of aspects 1 to 4, wherein the motor controller is further configured to cause the electric motors to rotate the stators in unison to a target position based on a compression level indicator.
6. The system of any of aspects 1 to 5 further comprising a plurality of resolvers corresponding to the stators, wherein the motor controller is further configured to cause one or more of the electric motors to rotate a corresponding one of the stators in a direction until a corresponding stop point is reached, wherein the motor controller is further configured to receive, from each of the resolvers, an indication of an angular position of the corresponding stop point in the direction the corresponding one of the stators was rotated.
7. The system of aspect 6, wherein the motor controller is further configured to store calibration information based on the indication of the angular position of the corresponding stop point in the direction the corresponding one of the stators was rotated.
8. An axial compressor for a gas turbine engine, the axial compressor comprising:

a plurality of blades configured to rotate about a rotation axis of the axial compressor;

a plurality of stators disposed in the compressor downstream from and adjacent to the blades, wherein the blades are configured to accelerate a fluid toward the stators when the blades rotate about the rotation axis, the stators are configured to redirect the fluid accelerated by the blades and to convert a circumferential component of the flow of the fluid into pressure, and wherein each of the stators is rotatable about a corresponding vane axis that extends radially outward from the rotation axis of the compressor;

a plurality of gear trains, each of the gear trains directly coupled to a corresponding one of the stators via a shaft positioned on the corresponding vane axis; and a plurality of electric motors, each of the electric motors directly coupled to a corresponding one of the gear trains, each of the electric motors configured to individually rotate the corresponding one of the stators via the corresponding one of the gear trains.

9. The axial compressor of aspect 8 further comprising a motor controller configured to cause the electric motors to rotate the stators in unison, the motor controller further configured to cause any of the electric motors to rotate the corresponding one of the stators independently from the other stators for calibration.
10. The axial compressor of any of aspects 8 or 9 further comprising a plurality of motor controllers, each of the motor controllers configured to control a corresponding one of the electric motors, wherein a master motor controller is configured to cause the electric motors to rotate the stators in unison through communication with the motor controllers.
11. The axial compressor of any of aspects 8 to 10, wherein the stators are included in a single stage of the axial compressor.
12. The axial compressor of any of aspects 8 to 11, wherein the stators are included in a portion of a single stage of the axial compressor.
13. The axial compressor of aspect 8 further comprising a plurality of resolvers corresponding to the stators, wherein each of the resolvers is configured to provide an indication of an angular position of a corresponding one of the stators.
14. The axial compressor of aspect 13, wherein each of the resolvers is configured to provide the indication of the angular position of the corresponding one of the stators based on an angular position of a corresponding one of the electric motors that is coupled to the corresponding one of the stators.
15. A method to control stators, the method comprising:

providing a plurality of stators in a compressor of a gas turbine engine and/or in a turbine of the gas turbine engine, each of the stators is rotatable about a corresponding vane axis that extends radially outward from a longitudinal axis of the compressor and/or the turbine;

providing a plurality of electric motors, each of the electric motors is configured to individually rotate a corresponding one of the stators in the compressor; and causing the electric motors to rotate the stators in unison during operation of the gas turbine engine thereby affecting power output by the gas turbine engine.

16. The method of aspect 15 further comprising calibrating the stators by causing the electric motors to rotate the stators independently from each other and receiving an indication of an angular position of each of the stators.
17. The method of any of aspects 15 or 16 further comprising:

receiving a plurality of pressure samples from pressure sensors located in a radial cross-sectional planar area of the gas turbine engine;

determine that the pressure sensor samples a match condition of a rotating stall event located in the radial cross-sectional planar area of the gas turbine engine; and correcting for the rotating stall event by causing one or more of the stators located at or adjacent to the location of the rotating stall event to rotate by activating one or more of the electric motors corresponding to the one or more of the stators.

18. The method of any of aspects 15 to 17 further comprising:

receiving a plurality of pressure samples from pressure sensors located in the gas turbine engine;

determine that the pressure sensor samples a match condition of a surge event located in the radial cross-sectional planar area of the gas turbine engine;

correcting for the surge event by causing one or more of the stators to rotate by activating one or more of the electric motors corresponding to the one or more of the stators.

19. The method of any of aspects 15 to 18 further comprising:

receiving a compression level indicator, the compression level indicator indicating a target compression level; and rotating each of the stators to a target angular position with the corresponding electric motors based on the target compression level.

20. The method of aspect 19 further comprising:

receiving an angular position of each of the stators from corresponding resolvers;

checking the received angular position against the target angular position; and causing the stators to be rotated to the target angular position if the received angular position fails to match the target angular position.

What is claimed is:

1. A system comprising:

a plurality of stators in a compressor for a gas turbine engine, the stators and a plurality of rotatable blades included in a stage of the compressor, the rotatable blades configured to rotate about an axis of the compressor, and each of the stators is rotatable about a corresponding vane axis that extends radially outward from the axis of the compressor;

a plurality of electric motors, each of the electric motors is configured to individually rotate a corresponding one of the stators in the compressor;

a motor controller configured to cause the electric motors to rotate the stators in unison; and a plurality of resolvers corresponding to the stators, wherein the motor controller is further configured to cause one or more of the electric motors to rotate a corresponding one of the stators in a direction until a corresponding stop point is reached, wherein the corresponding stop point is a point at which the corresponding one of the stators is physically prevented from, or encounters resistance to, rotating further in the direction, wherein the motor controller is further configured to receive, from each of the resolvers, an indication of an angular position of the corresponding stop point in the direction the corresponding one of the stators was rotated, wherein the motor controller is further configured to determine an actual angular position of the corresponding one of the stators that corresponds to a target position of the corresponding one of the stators based on the indication of the angular position of the corresponding stop point in the direction the corresponding one of the stators was rotated.

2. The system of claim 1 further comprising a plurality of gear trains, wherein each of the electric motors is mechanically coupled to the corresponding one of the stators by a corresponding one of the gear trains.

3. The system of claim 1, wherein the motor controller is configured to cause the electric motors to rotate in unison to a target angular position.

4. The system of claim 1, wherein the motor controller is further configured to cause one or more of the electric motors to rotate one or more of the stators in the stage of the compressor in response to a detection of a stall event and/or a surge event.

5. The system of claim 1, wherein the motor controller is further configured to cause the electric motors to rotate the stators in unison to a target position based on a compression level indicator.

6. An axial compressor for a gas turbine engine, the axial compressor comprising:

a plurality of blades configured to rotate about a rotation axis of the axial compressor;

a plurality of stators disposed in the axial compressor downstream from and adjacent to the blades, wherein the blades are configured to accelerate a fluid toward the stators when the blades rotate about the rotation axis, the stators are configured to redirect the fluid accelerated by the blades and to convert a circumferential component of the flow of the fluid into pressure, and wherein each of the stators is rotatable about a corresponding vane axis that extends radially outward from the rotation axis of the axial compressor;

a plurality of gear trains, each of the gear trains directly coupled to a corresponding one of the stators via a shaft positioned on the corresponding vane axis;

a plurality of electric motors, each of the electric motors directly coupled to a corresponding one of the gear trains, each of the electric motors configured to individually rotate the corresponding one of the stators via the corresponding one of the gear trains;

a motor controller; and a plurality of resolvers corresponding to the stators, wherein the motor controller is further configured to cause one or more of the electric motors to rotate a corresponding one of the stators in a direction until a corresponding stop point is reached, wherein the corresponding stop point is a point at which the corresponding one of the stators is physically prevented from, or encounters resistance to, rotating further in the direction, wherein the motor controller is further configured to receive, from each of the resolvers, an indication of an angular position of the corresponding stop point in the direction the corresponding one of the stators was rotated, wherein the motor controller is further configured to determine an actual angular position of the corresponding one of the stators that corresponds to a target position of the corresponding one of the stators based on the indication of the angular position of the corresponding stop point in the direction the corresponding one of the stators was rotated.

7. The axial compressor of claim 6 further comprising a motor controller configured to cause the electric motors to rotate the stators in unison, the motor controller further configured to cause any of the electric motors to rotate the corresponding one of the stators independently from the other of the stators for calibration.

8. The axial compressor of claim 6 further comprising a plurality of motor controllers, each of the motor controllers configured to control a corresponding one of the electric motors, wherein a master motor controller is configured to cause the electric motors to rotate the stators in unison through communication with the motor controllers.

9. The axial compressor of claim 6, wherein the stators are included in a single stage of the axial compressor.

10. The axial compressor of claim 6, wherein the stators are included in a portion of a single stage of the axial compressor.

11. A method to control stators, the method comprising:

providing a plurality of stators in a compressor of a gas turbine engine and/or in a turbine of the gas turbine engine, each of the stators is rotatable about a corresponding vane axis that extends radially outward from a longitudinal axis of the compressor and/or the turbine;

providing a plurality of electric motors, each of the electric motors is configured to individually rotate a corresponding one of the stators in the compressor;

causing the electric motors to rotate the stators in unison during operation of the gas turbine engine thereby affecting power output by the gas turbine engine;

calibrating the stators by causing the electric motors to rotate the stators independently from each other in a direction until the stators reach corresponding stop points, receiving a plurality of indications of angular positions of the corresponding stop points from a plurality of resolvers; and determining actual angular positions of the stators that correspond to target positions of the stators based on the indications of angular positions of the corresponding stop points.

12. The method of claim 11 further comprising:

receiving a plurality of pressure samples from pressure sensors located in a radial cross-sectional planar area of the gas turbine engine;

determine that the pressure samples a match condition of a rotating stall event located in the radial cross-sectional planar area of the gas turbine engine; and correcting for the rotating stall event by causing one or more of the stators located at or adjacent to a location of the rotating stall event to rotate by activating one or more of the electric motors corresponding to the one or more of the stators.

13. The method of claim 11 further comprising:

receiving a plurality of pressure samples from pressure sensors located in the gas turbine engine;

determine that the pressure samples a match condition of a surge event located in a radial cross-sectional planar area of the gas turbine engine;

correcting for the surge event by causing one or more of the stators to rotate by activating one or more of the electric motors corresponding to the one or more of the stators.

14. The method of claim 11 further comprising:

receiving a compression level indicator, the compression level indicator indicating a target compression level; and rotating each of the stators to a target angular position with the corresponding electric motors based on the target compression level.

15. The method of claim 14 further comprising:

receiving an angular position of each of the stators from the resolvers;

checking the received angular position against the target angular position; and causing the stators to be rotated to the target angular position if the received angular position fails to match the target angular position.

* * * * *